US005605497A

United States Patent [19]

Pickard

[11] Patent Number: 5,605,497

[45] Date of Patent: Feb. 25, 1997

[54] AIR/ABRASSIVE MIXING DEVICE

[75] Inventor: Robert W. Pickard, McLoud, Okla.

[73] Assignee: The Pickard's Trust, McLoud, Okla.

[21] Appl. No.: 441,429

[22] Filed: May 15, 1995

[51] Int. Cl.[6] ..... B24C 3/04

[52] U.S. Cl. ..... 451/90; 451/99; 451/101; 239/379

[58] Field of Search ..... 222/630, 637; 406/14, 146; 451/38, 39, 40, 75, 90, 99, 101, 446; 251/121, 205, 213; 239/379

[56] References Cited

U.S. PATENT DOCUMENTS

| | | | |
|---|---|---|---|
| 671,410 | 4/1901 | Warren | 451/99 |
| 758,118 | 4/1904 | Sticker | 451/99 |
| 791,176 | 5/1905 | Breidster . | |
| 911,431 | 2/1909 | Nichols | 451/99 |
| 3,267,615 | 8/1966 | Moore . | |
| 3,624,967 | 12/1971 | Kamper et al. . | |
| 3,626,841 | 12/1971 | Schachter . | |
| 4,233,785 | 11/1980 | Abell | 451/90 |
| 4,569,161 | 2/1986 | Shipman | 451/99 |
| 5,083,402 | 1/1992 | Kirschner et al. | 451/38 |

FOREIGN PATENT DOCUMENTS

| | | | |
|---|---|---|---|
| 525444 | 9/1921 | France | 451/99 |
| 526568 | 10/1921 | France | 451/99 |
| 1121042 | 7/1956 | France | 451/99 |

*Primary Examiner*—Timothy V. Eley
*Attorney, Agent, or Firm*—Molly D. McKay, P.C.

[57] ABSTRACT

A device for mixing compressed air and abrasive and providing the air/abrasive mixture to a delivery gun for use in artistic abrasive blasting. The device is provided with a vessel having an upper chamber for holding abrasive. Compressed air is supplied to a head space located in the upper chamber above the abrasive. An air delivery line extends from the head space to a mixing chamber located below the upper chamber in order to supply compressed air thereto. An adjustable mixing valve admits abrasive from the upper chamber into the mixing chamber where the abrasive is mixed with the compressed air before it exits the mixing chamber on its way to the delivery gun.

18 Claims, 3 Drawing Sheets

AIR/ABRASSIVE MIXING DEVICE

BACKGROUND OF THE INVENTION

1. Field of the Invention

The present invention is a device for mixing air and abrasive for use in artistically etching glass by abrasive blasting.

2. Description of the Related Art

Various means are employed to etch designs into glass. One means is to employ a chemical etching agent, such as hydrofluoric acid on the portion of glass to be etched. Chemical etching agents do not provide adequate control over the degree of etching achieved in order to be practical for artistic etching. Also, use of hydrofluoric acid presents potential health and safety concerns as it will aggressively attach human tissues if the user accidentally gets the hydrofluoric acid on his body.

Another means which is widely used to etch glass is a grinding wheel, usually a copper wheel, which can-be used to cut the glass. This means is generally employed to produce fine cut glass and lead crystal pieces.

A means which has more recently appeared for etching glass is to use various types of heated materials which are applied to the glass in order to chip the glass thermally.

A final means which is used to etch glass is by abrasive blasting. Various mixing devices have been employed to mix a pressurized carrier, such as air, with an abrasive, such as sand, so that the mixture of air and abrasive can be delivered where it is needed in order to etch the glass. In order to do artistic abrasive etching, it is critical to be able to precisely control the ratio of air to abrasive flowing from the delivery gun during the entire time the delivery gun is activated. Also, the flows of abrasive and air must be adjusted in order to achieve varying degrees of etching depth. Specifically, the abrasive rate of flow has to be simultaneously varied from a low rate of about 2 ounces per minute for shadow etching up to a maximum rate of about 14 pounds per minute for deep etching, and the air pressure has to be varied from a low pressure of about 3 pounds per square inch (psi) up to a maximum pressure of about 50 psi.

Controlling the differential pressure across the mixing valve is also critical so that pressure in the mixing chamber is always less than or equal to, but is never greater than, the pressure on the abrasive contained in the vessel. If the differential pressure is not properly maintained, flow of abrasive ceases because flow through the mixing valve is reversed, sending air from the mixing chamber, through the mixing valve and into the vessel, instead of allowing the normal flow to occur, i.e., flow of abrasive from the vessel, through the mixing valve and into the mixing chamber.

The present invention is capable of producing consistently correct air to abrasive ratios in its air/abrasive mixture over a wide range of abrasive flow rates and air pressures while constantly maintaining proper differential pressures across the mixing valve. The present invention controls the ratio of air to abrasive flow by three means. First, the ratio is controlled by controlling air flow to a head space of the vessel by means of an adjustable air regulator. Second, the ratio is controlled by controlling the abrasive flow from the vessel to the mixing chamber. The abrasive flow is controlled by means of an adjustable mixing valve and by means of the differential pressure created between the mixing chamber and the vessel which are connected via an air delivery line extending from the vessel's head space to the mixing chamber. The air delivery line supplies air to the mixing chamber and insures that the differential pressure between the vessel's head space and the mixing valve is either positive, i.e., the head space's air pressure exceeds the mixing chamber's air pressure, as when abrasive blasting is being performed, or zero, i.e., the head space's air pressure is the same as the mixing chamber's air pressure, as when abrasive blasting has ceased. And third, the ratio is controlled by limiting the amount of abrasive which accumulates in the mixing chamber when abrasive blasting is temporarily suspended, thus preventing an increased proportion of abrasive from being included in the air/abrasive mixture when abrasive blasting resumes.

Important objectives of the present invention include the provision of a mixing device capable of having flows of both air and abrasive easily adjusted while the device is in service, a mixing device which prevents significant buildup of abrasive in its mixing chamber when abrasive blasting is temporarily suspended, a mixing device which will consistently deliver a given air to abrasive ratio, a mixing device which constantly maintains a desirable differential pressure across its mixing value and a mixing device with a straight mixing chamber in order to reduce abrasion to the device by the air/abrasive mixture.

SUMMARY OF THE INVENTION

The present invention is a device for mixing air and abrasive for use in artistically etching materials by abrasive blasting. Compressed air is supplied to the device by an air supply line which connects to a regulator provided on a top surface of the device. The regulator is connected via a hollow air tube to a head space provided in an upper chamber of a vessel of the device. An external end of the air tube attaches to the regulator and an internal end of the air tube extends into the head space of the upper chamber of the vessel. Air pressure into the head space of the upper chamber is adjusted by turning a regulator knob provided on the regulator and by monitoring pressure by means of a pressure gauge provided on the regulator.

The top surface of the device is also provided with a hollow fill tube which extends through a wall of the vessel into the upper chamber. A first end of the fill tube is threaded and is external to the vessel. A removable threaded cap threadably engages the first end of the fill tube to provide an air tight seal therewith. The cap is removed to add abrasive to the upper chamber via the fill tube. The fill tube extends downward into the upper chamber some distance in order to prevent sand from filling in the head space located in the upper chamber above the abrasive.

The vessel is provided with a downwardly tapering conically shaped dividing wall which separates the upper chamber from a lower chamber of the vessel. A downwardly tapering frusto-conical segment is provided centrally in the downwardly tapering conically shaped dividing wall. The frusto-conical segment provides communication between the upper chamber and a horizontal mixing chamber located in the lower chamber.

A conical valve stem is movably located within the frusto-conical segment and together the valve stem and the frusto-conical segment form a mixing valve for regulating flow of abrasive into the mixing chamber from the upper chamber. The segment extends downward into the mixing chamber between a receiving end and an opposite dispensing end of the mixing chamber. The valve stem seats into the frusto-conical segment when the valve stem is moved downward relative to the segment. When the valve stem moves upward relative to the segment, the mixing valve opens increasingly wider. The valve stem is moved upward and downward relative to the segment by means of a connecting rod which attaches on its lower internal end to the valve stem. The opposite upper external end of the connecting rod is threaded and movably extends through a threaded bushing provided in the wall of the top surface of the vessel. The external end of the connecting rod makes an air tight seal with the bushing and is provided with a valve handle located external to the vessel. When the valve handle is turned, the connecting rod turns in the bushing, thus raising or lowering the valve stem relative to the segment, depending on the direction which the valve handle is turned.

An upper end of a hollow air delivery line is located in the head space of the upper chamber and an opposite lower end of the air delivery line attaches to the receiving end of the mixing chamber. Flexible tubing attaches by one end to the dispensing end of the mixing chamber and connects by an opposite end to a delivery gun which is held in a user's hand. In order to direct an air/abrasive mixture toward an article to be etched, a trigger provided on the delivery gun is depressed, thus causing abrasive and air to mix in the mixing chamber and flow via the flexible tubing to the delivery gun and out a nozzle of the delivery gun onto the article to be etched.

DETAILED DESCRIPTION OF THE PREFERRED EMBODIMENT

Figure 1:
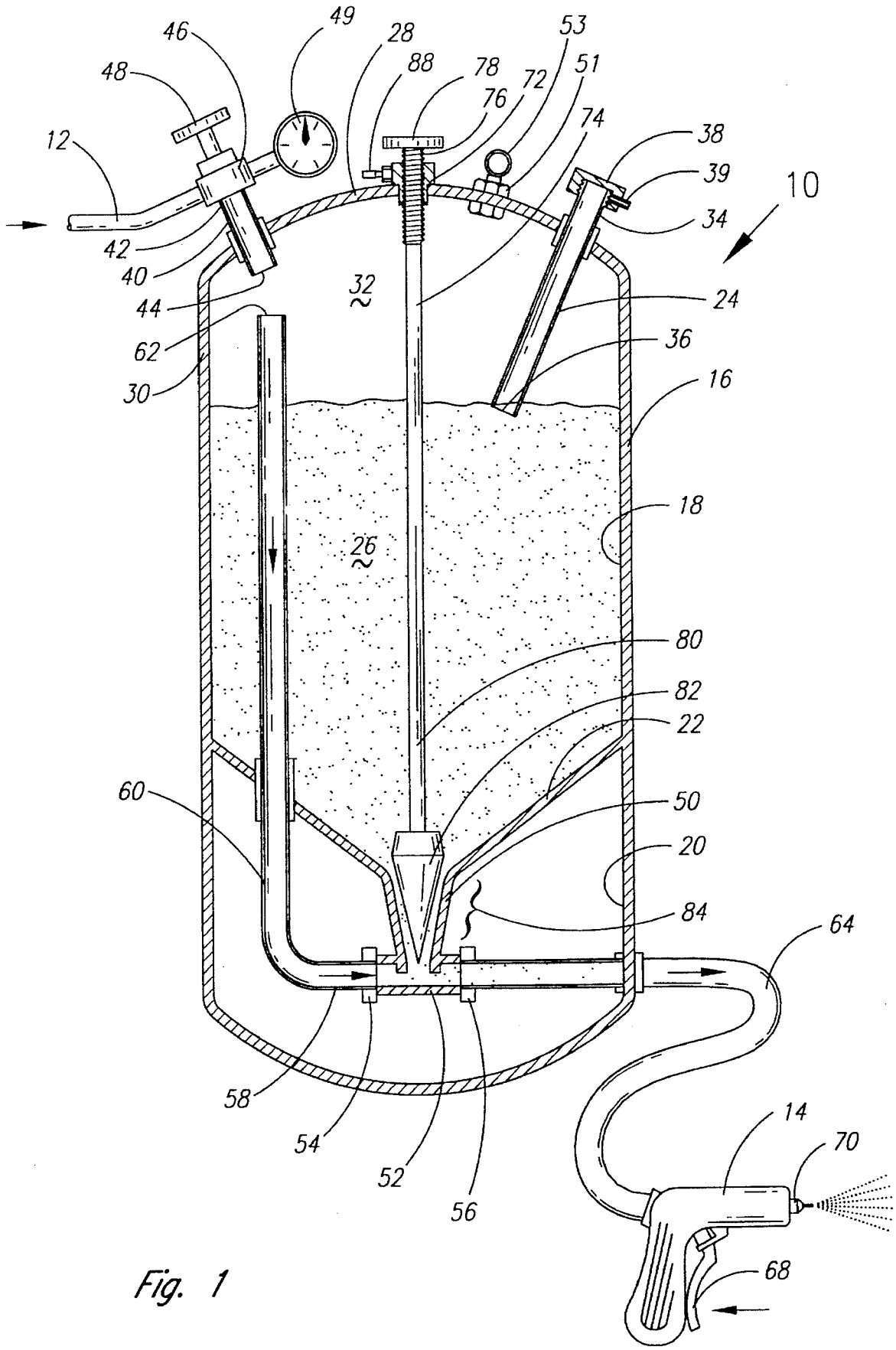
FIG. 1 is a cut-away view of an air/abrasive mixing device constructed according to a preferred embodiment of the present invention, showing the device being used in abrasive blasting.

Referring now to the drawings, and initially to FIG. 1, there is illustrated an air/abrasive mixing device 10 constructed according to a preferred embodiment of the present invention. The device 10 is shown in FIG. 1 attached to a separate air supply line 12 and a separate delivery gun 14 which are [not a part of the present invention, but are]used with the device 10.

Figure 2:
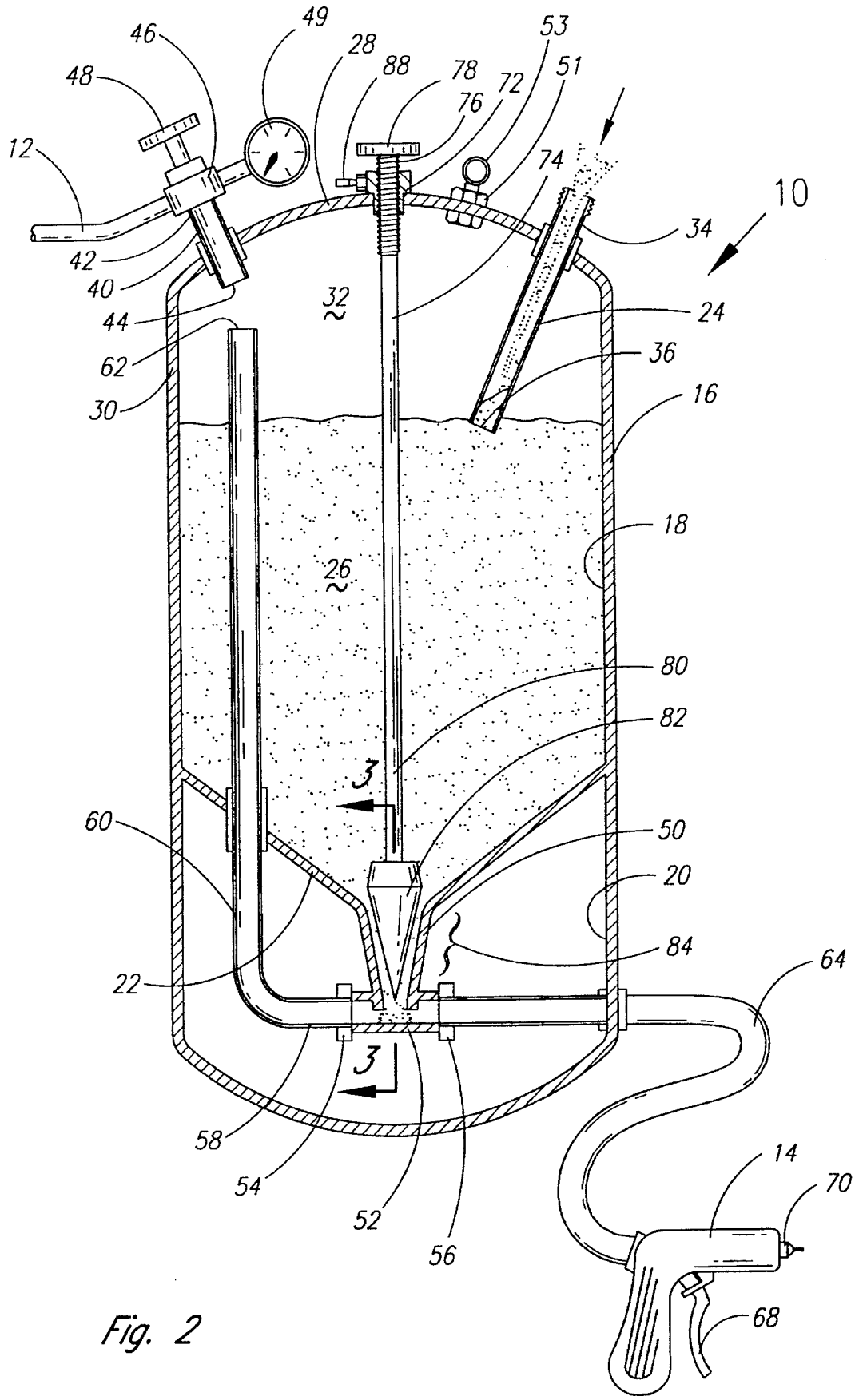
FIG. 2 is the device of FIG. 1 shown as it would appear when being refilled with abrasive.

The device 10 is provided with a vessel 16 having an upper chamber 18 and a lower chamber 20 separated from each other by means of a downwardly tapering, conically shaped dividing wall 22. The upper chamber 18 is partially filled with fine particulate abrasive 26 via a fill tube 24 provided in the device 10. The fill tube 24 extends downward from a top surface 28 of the vessel 16, through a wall 30 of the vessel 16 and into a head space 32. The head space 32 is provided above the abrasive 26 in the upper chamber 18. A first end 34 of the fill tube 24 extends upward from the top surface 28 and an opposite second end 36 extends downward some distance into the upper chamber 18. The fill tube 24 is hollow and provides communication between its first end 34, which is located external to the vessel 16, and its second end 36, which is located in the upper chamber 18. The first end 34 is externally threaded to removably receive an internally threaded cap 38 for providing an air tight seal on the first end 34. The purpose for having the second end 36 extend downward into the upper chamber 18 is to insure that when abrasive 26 is added to the device 10, as illustrated in FIG. 2, the upper chamber 18 cannot be overfilled with abrasive 26 and thereby eliminate the head space 32. The importance of maintaining the head space 32 will become apparent hereafter.

The cap 38 is provided with a small cap opening 39 located in a side of the cap 38 so that if the cap 38 is removed without first releasing pressure from the vessel 16, air will flow out the cap opening 39 alerting the user that the vessel 16 is pressurized before the cap 38 is unscrewed completely and is blown away from the fill tube 24, causing a dangerous situation.

The top surface 28 is also provided with an air tube 40 which extends through the wall 30. The air tube 40 has an external end 42, which is located external to the vessel 16, and an opposite internal end 44, which is located in the head space 32 of the upper chamber 18. The external end 42 attaches to an air regulator 46 which in turn is attached to the air supply line 12. The air supply line 12 supplies pressurized air to the regulator 46. The regulator 46 is provided with a regulator knob 48 which can be turned in order to regulate the flow of air entering the external end 42 of the air tube 40. The regulator 46 is provided with a pressure gauge 49 which indicates the pressure of the air entering the external end 42 of the air tube 40. The air tube 40 is hollow and provides gaseous communication between the regulator 46 and the head space 32.

A safety release valve 51 is also provided on the top surface 28 and extends through the wall 30. The safety release valve 51 will automatically release pressure from the vessel 16 if a safe pressure limit is exceeded. Also, the safety release valve 51 has a ring 53 which may be pulled outward in order to manually release pressure from the vessel 16.

Figure 3:
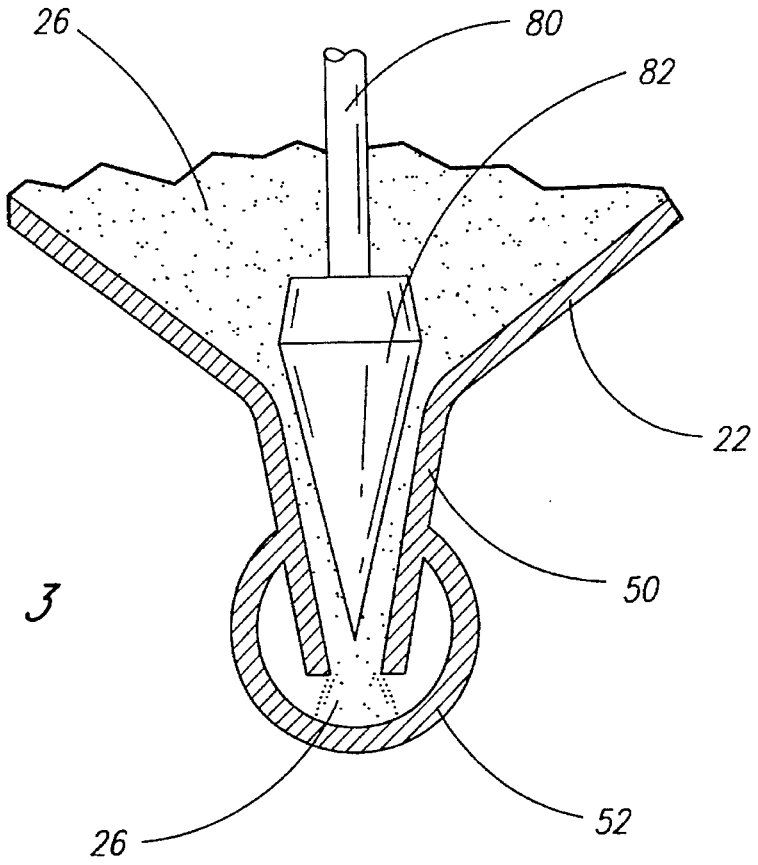
FIG. 3 is a cross-sectional view taken along line 3—3 of FIG. 2.

The conically shaped dividing wall 22 is provided centrally with a downwardly tapering frusto-conical segment 50. The segment 50 extends downward into a horizontally oriented mixing chamber 52, as illustrated in FIGS. 2 and 3. The mixing chamber 52 is located within the lower chamber 20 of the vessel 16, and the segment 50 provides communication between the upper chamber 18 and the mixing chamber 52. The horizontal mixing chamber 52 is a straight hollow tube which has a receiving end 54 and an opposite dispensing end 56.

The receiving end 54 attaches to a lower end 58 of an air delivery line 60. The air delivery line 60 extends through the dividing wall 22 and is provided with an opposite upper end 62 located in the head space 32. The air delivery line 60 is hollow and provides gaseous communication between the head space 32 and the receiving end 54 of the mixing chamber 52. The mixing chamber 52 is hollow between its two ends 54 and 56 with the segment 50 entering the mixing chamber at a location between the two ends 54 and 56.

The dispensing end 56 of the mixing chamber 52 is attached via flexible tubing 64 to the delivery gun 14. Generally, the delivery gun 14 is held in the user's hand (not illustrated) and is provided with a spring biased trigger 68. When the trigger 68 is depressed, as illustrated in FIG. 1, air and abrasive flow consecutively from the mixing chamber 52, through the tubing 64, through the delivery gun 14 and out a nozzle 70 provided on the delivery gun 14 so that the air/abrasive mixture impinges on an object, (not illustrated), usually glass, which is to be etched. When the trigger 68 is released, the trigger 68 returns to its original position and flow of air and abrasive ceases, as illustrated in FIG. 2.

Figure 4:
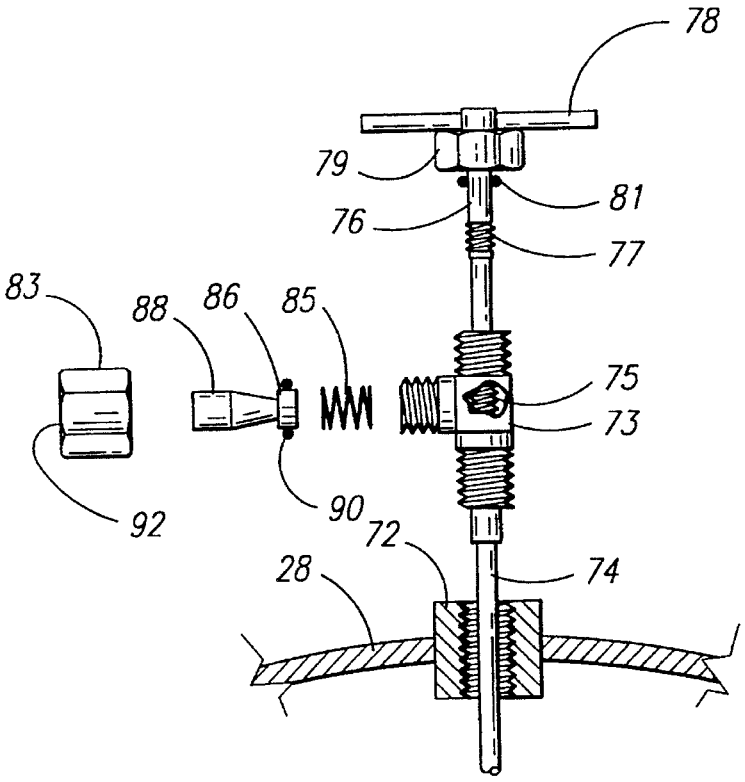
FIG. 4 is an exploded view of the upper external end of the connecting rod of the invention of FIGS. 1 and 2.

Referring now also to FIG. 4, an internally threaded bushing 72 is provided in the top surface 28 of the vessel 16 and extends through the wall 30 of the vessel 16. A male threaded T-connector 73 removably secures to the bushing 72, and the connecting rod 74 movably extends through the T-connector 73. The T-connector 73 is provided internally with female threads 75 with which male threads 77 provided on an upper external end 76 of a connecting rod 74 movably engage. A fitting 79 provided with an O-ring 81 is movably provided on the upper external end 76 between a valve handle 78 and the male threads 76. The fitting 79 secures upper external end 76 to the T-connector 73 so that an airtight seal is created therebetween. The valve handle 78 is provided on the upper external end 76 of the connecting rod 74 and can be turned in order to raise or lower the connecting rod 74 relative to the vessel 16. A second fitting 83 is provided attached to the T-connector 73. Within the second fitting 83, a spring 85 biases outward against a base 86 of a lever 88. A second O-ring 90 is provided around the lever 88 at its base 86 so that the outwardly biased base 86 presses the O-ring against the second fitting 83 and thereby creates an airtight seal therebetween.

The connecting rod 74 is provided with an opposite lower internal end 80 located within the upper chamber 18. The lower internal end 80 is provided with a downwardly extending conical valve stem 82. The valve stem 82 is preferably constructed of a flexible material such as rubber or soft plastic. By turning the valve handle 78, the valve stem 82 is lowered until it seats internally in the frusto-conical segment 50 to stop flow of abrasive 26 into the mixing chamber 52. Likewise, to allow abrasive 26 to resume flowing into the mixing chamber 52 from the upper chamber 18, or alternatively, to increase flow of abrasive 26 to the mixing chamber 52, the valve handle 78 is turned in the opposite direction.

The valve stem 82 and the segment 50 jointly form a mixing valve 84 which regulates whether and how much abrasive 26 flows into the mixing chamber 52. Flow of the abrasive 26 is affected by two additional factors, the influence of gravity which causes the abrasive 26 to fall through the open mixing valve 84 and a pressure differential, if any, existing between the upper chamber 18 and the mixing chamber 52 which tends to push abrasive 26 through the mixing valve 84. Since the mixing valve 84 extends between these two chamber 18 and 52, the pressure differential between these chambers 18 and 52 could be stated as the pressure differential across the mixing valve 84. Pressure differential is created whenever the trigger 68 of the delivery gun 14 is depressed. Depressing the trigger 68 thereby creates a drop in air pressure beginning at the nozzle and extending consecutively through the delivery gun 14, the tubing 64, the mixing chamber 52, the air delivery line 60, and the upper chamber 18.

Thus, when the trigger 68 is depressed, air from the head space 32 of the upper chamber 18 enters the mixing chamber 52 via the air delivery line 60, mixes in the mixing chamber 52 with abrasive 26 which has passed through the mixing valve 84, and then the air/abrasive mixture flows in a straight path out of the device 10 to the delivery gun 14 and is sprayed out of the delivery gun 14 at the nozzle 70. It is important that once the air and abrasive 26 have mixed together in the mixing chamber 52, the air/abrasive mixture does not have to negotiate any turns while moving through the device 10 since the mixture is quite abrasive and could easily eat through metal should the mixture continually impinge thereon.

Whenever the trigger 68 is released, when the regulator knob 48 is first adjusted to stop air flow through the regulator 46 and then the trigger 68 has been depressed in order to allow the pressure gauge 49 to register 0 psi, when the regulator knob 48 is first adjusted to stop air flow through the regulator 46 and then the ring 53 is pulled outward in order to allow the pressure gauge 49 to register 0 psi, or when the regulator knob 48 is first adjusted to stop air flow through the regulator 46 and then the lever 88 is moved sideways in order to allow the pressure gauge 49 to register 0 psi, there is no pressure differential across the mixing valve 84. When no pressure differential exists across the mixing valve 84 and if the mixing valve 84 is allowed to remain open, gravity will cause the abrasive 26 to continue to fall through the mixing valve 84 until a small amount of the abrasive 26 accumulates in a bottom of the mixing chamber 52, as is shown in FIGS. 2 and 3. Extension of the segment 50 into the mixing chamber 52 limits the amount of abrasive 26 which will accumulate in the mixing chamber 52. Once the trigger 68 is again depressed, air flows around the small amount of abrasive 26 which had accumulated in the mixing chamber 52 during secession of abrasive blasting and the accumulated abrasive 26 is easily and quickly blown out of the mixing chamber 52 with the normal air/abrasive mixture and does not significantly affect the relative proportion of abrasive 26 to air in the mixture, even during the first few seconds after the trigger 68 is depressed, While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device for mixing air and abrasive for use in artistic abrasive blasting comprising:

an upper chamber for receiving abrasive, abrasive being provided in said upper chamber so as to partially fill said upper chamber, means for regulating introduction of air into said upper chamber, an air delivery line extending between said upper chamber above said abrasive and a receiving end of a mixing chamber, said mixing chamber being straight between said receiving end and an opposite dispensing end provided on said mixing chamber, adjustable valve means for admitting said abrasive into said mixing chamber from said upper chamber, and means for flexibly attaching a delivery gun to said dispensing end of said mixing chamber.

2. A device according to claim 1 wherein said adjustable valve means further comprises:

a hollow downwardly tapering frusto-conical segment being provided between said upper chamber and said mixing chamber, a conical valve stem being movably engagable with said segment, said valve stem being attached to one end of a connecting rod, an opposite threaded second end of said connecting rod being movably provided extending through a threaded bushing provided in a wall of said upper chamber, and a valve handle being provided on said second end of said connecting rod so said valve handle is external to said upper chamber and can be turned to raise and lower said valve stem relative to said segment.

3. A device according to claim 2 wherein said bushing is provided in a top surface of a vessel and said upper chamber is contained within said vessel.

4. A device according to claim 3 wherein said means for regulating introduction of air into said upper chamber is provided in said top surface.

5. A device according to claim 2 wherein said segment extends into said mixing chamber between said receiving end and said dispensing end.

6. A device according to claim 1 wherein said mixing chamber is a straight tube which extends between said receiving end and said dispensing end.

7. A device according to claim 6 wherein said mixing chamber is horizontally oriented.

8. A device for mixing air and abrasive for use in artistic abrasive blasting comprising:

an upper chamber for receiving abrasive, abrasive being provided in said upper chamber so as to partially fill said upper chamber, means for regulating introduction of air into said upper chamber, an air delivery line extending between said upper chamber above said abrasive and a receiving end of a mixing chamber, adjustable valve means for admitting said abrasive into said mixing chamber from said upper chamber, means for flexibly attaching a delivery gun to a dispensing end of said mixing chamber, a hollow fill tube being provided with one end which extends into said upper chamber as a means for admitting said abrasive into said upper chamber, an opposite end of said fill tube being provided external to said upper chamber, and a cap being removably attached to said opposite end of said fill tube.

9. A device for mixing a carrier substance and an abrasive in order that the mixture can be used in abrasive blasting comprising:

a vessel being provided internally with a downwardly tapering dividing wall separating said vessel into an upper chamber and a lower abrasive being provided in said upper chamber, means for introducing abrasive into said upper chamber while maintaining a head space in said upper chamber above said abrasive, means for introducing a carrier substance into said upper chamber, a conduit extending from said upper chamber above said abrasive to one end of a mixing chamber located in said lower chamber in order to supply carrier substance to said mixing chamber, and an adjustable mixing valve being provided in said dividing wall in order to admit abrasive from the upper chamber into said mixing chamber.

10. A device according to claim 9 further comprising:

an opposite end of said mixing chamber being attached by means of flexible tubing to a delivery gun.

11. A device according to claim 10 wherein:

said mixing valve extends downward into said mixing chamber at a location between the ends of said mixing chamber.

12. A device according to claim 9 further comprising:

a valve handle provided on an upper external end of a connecting rod, said external end being movably engaged with a threaded bushing provided in a wall of said upper chamber, an opposite lower internal end of said connecting rod being attached to a valve stem of said mixing valve as a means of adjusting said mixing valve.

13. A device according to claim 12 wherein said mixing valve is further comprised of a frusto-conical segment provided in said dividing wall, and said valve stem being movably engagable with said segment.

14. A device according to claim 12 further comprising:

a lever means provided attached to said threaded bushing for releasing pressure from said vessel.

15. A device according to claim 9 wherein said mixing chamber is a straight, horizontally oriented hollow tube.

16. A device according to claim 9 wherein said means for introducing a carrier substance into said upper chamber further comprises:

a regulator being attached to an air supply line, one end of an air tube being attached to said regulator, an opposite end of said air tube communicating with said upper chamber, and a pressure gauge being attached to said regulator.

17. A device according to claim 9 wherein said means for introducing abrasive into said upper chamber while maintaining a head space further comprises:

a fill tube being provided extending through said vessel so that a first end of said fill tube is external to said vessel and an opposite end of said fill tube extends downward into said upper chamber, a cap being removably attachable to said first end of said fill tube, and said cap being provided with a cap opening for warning a user that the vessel is pressurized before the cap is completely removed from said first end.

18. A device according to claim 9 further comprising:

a safety release valve being provided in said vessel so that said safety release valve communicates between said upper chamber and the outside atmosphere.

* * * * *